United States Patent [19]

Cartwright

[11] Patent Number: 4,566,846

[45] Date of Patent: Jan. 28, 1986

[54] CARTON TRANSFER APPARATUS WITH EFFECTIVE CONSTANT LENGTH INVERTING ARM

[75] Inventor: Willard E. Cartwright, Los Altos, Calif.

[73] Assignee: Kliklok Corporation, Greenwich, Conn.

[21] Appl. No.: 450,523

[22] Filed: Dec. 17, 1982

[51] Int. Cl.[4] ..... B23Q 7/04

[52] U.S. Cl. ..... 414/742; 271/31.1; 271/107; 414/330; 414/737

[58] Field of Search ..... 414/330, 728, 729, 737, 414/742, 733, 744 A, 744 B, 744 R; 271/8 A, 30 A, 100, 107

[56] References Cited

U.S. PATENT DOCUMENTS

| | | | |
|---|---|---|---|
| 2,624,249 | 1/1953 | Baker et al. | 264/571 |
| 2,790,536 | 4/1957 | Reed | 414/728 X |
| 2,805,060 | 9/1957 | Lefief | 271/11 |
| 3,008,385 | 11/1961 | Pierce, Jr. | 493/124 |
| 3,176,978 | 4/1965 | Baker et al. | 271/5 |
| 3,269,724 | 8/1966 | Lefief | 271/107 |
| 3,361,295 | 1/1968 | Marchant | 221/122 |
| 3,390,875 | 7/1968 | Beert | 271/5 |
| 3,902,606 | 9/1975 | Rönbeck | 414/733 |
| 4,097,040 | 6/1978 | Pugh et al. | 271/104 |
| 4,155,546 | 5/1979 | Jacobs | 271/11 |

*Primary Examiner*—Robert J. Spar
*Assistant Examiner*—Janice Krizek
*Attorney, Agent, or Firm*—King, Liles & Schickli

[57] ABSTRACT

A carton transfer apparatus including an inverting arm having a carrier for transferring individual blanks of flexible paperboard material. The inverting arm pivots so that its effective length remains constant throughout its feeding movement. The inverting arm specifically pivots about a follower on one of its ends; the follower being movable along a track to vary the location of the pivotal axis during the feed movement. The track is secured to a pivotable support member. A feed arm drives the inverting arm and the support member is rotated in timed relationship by an interconnecting link. As the follower on the inverting arm moves along the track, the effective length of the arm is maintained substantially the same so as not to impose acceleration movement on the carrier.

13 Claims, 4 Drawing Figures

CARTON TRANSFER APPARATUS WITH EFFECTIVE CONSTANT LENGTH INVERTING ARM

BACKGROUND

The present invention relates to transfer mechanisms for feeding individual blanks of flexible sheet material from a blank pickup station to a blank discharge station. In particular, the invention is directed to a system including an inverting arm of effective constant pivotal length having a pivot location that varies as the arm transfers individual blanks between the pickup and the discharge locations. The invention will be specifically disclosed in connection with an inverting arm in an apparatus for pivotally moving an individual blank approximately 90° from a storage magazine for a stack of individual blanks to a forming station where the blank is folded into a box or a carton structure.

It is well known in the art to stack a plurality of flat foldable paperboard blanks in a blank storage magazine of a box forming machine and to thereafter separate and remove the forward blank from the stack for transfer to a forming station. Most commonly, the blank is engaged by suction cups on a feed carrier during removal from the stack and transfer movement. As the feed carrier is moved to the forming die, the blank is inverted and then placed on the forming die, vacuum in the suction cups is then terminated and the blank is released from the feed carrier.

One example of a blank forming machine is disclosed in U.S. Pat. No. 3,269,724 wherein the feed carrier engaging the blank is secured to a carriage. The carriage has rollers which are movingly disposed in cam tracks to guide the carriage and attached feed carrier upwardly and downwardly between a magazine supporting a stack of paperboard blanks and a forming die. A plunger cooperatively interacts with the die and folds the flat paperboard blanks into a box like or carton structure.

The most prevalent design in contemporary carton forming machines has a driven feed carrier mounted on the end of a pivoting inverting arm. In this design, the feed carrier also has suction cups for engaging and removing the individual blanks from the stack of blanks in a magazine holder. In this last mentioned design, the inverting arm is used to pivotally move the feed carrier and vacuum secured blank through approximately 90° from the magazine to the forming station. However, inasmuch as the blanks must first be removed from the magazine and thereafter positioned in a forming station, the transfer movement of the blank is not a simple arc. Instead, it is desirable to extend and retract the inverting arm along a relatively straight line at both the magazine pickup location and the forming means discharge location.

In order to effectuate the combined pivoting and extension/retraction movements, the inverting arms of the prior art have guideways slideable on fixed studs. These guideways allow longitudinal sliding movement of the inverting arms relative to the studs. However, during the feed movement of the inverting arm, in this prior design, the arm is longitudinally moved with respect to the pivoting stud. Simultaneously, the inverting arm is pivoted about this same stud. Hence, the pivot point of the inverting arm is fixed, but the arm's effective pivotal length varies. Unfortunately, this variation in the inverting arm's length adds unwanted speed and acceleration to the feed movement of the paperboard blank during the middle portion of the cycle. Examples of this prevalent fixed pivot, but variable pivot length design are disclosed in U.S. Pat. Nos. 2,624,249; 2,805,060 and 3,176,978.

A further type of inverting arm design is found in U.S. Pat. No. 3,008,385. In this design, an inverting arm has a track guide disposed about a pivotal roller for guiding both longitudinal movement of the arm relative to the pivotal roller and pivotal movement. Unlike the fixed pivot designs discussed above, however, this pivotal roller is mounted about a bell crank and is not fixed relative to the machine base. Nevertheless, the inverting arm moves longitudinally with respect to the pivotal roller and the pivotal length of the inverting arm is variable throughout the feed movement.

SUMMARY OF THE INVENTION

Accordingly, it is an object of the present invention to provide a transfer apparatus having an inverting arm for a carton blank having an effective constant pivot length to obviate deleterious added acceleration during transfer movement.

It is a further object of the present invention to provide a transfer apparatus with an inverting arm for a blank transfer mechanism with greater control and increased speed capacity.

Another objective of the present invention is to provide a transfer apparatus having an inverting arm not imposing an acceleration factor in the drive means for the apparatus allowing a substantial increase in overall speed of the operation.

It is another object of the present invention to provide an apparatus for transferring a carton by an inverting mechanism having a follower to move along a track to maintain an effective constant length arm.

Additional objects, advantages and other novel features of the invention will be set forth in part in the description that follows and in part will become apparent to those skilled in the art upon examination of the following or may be learned with the practice of the invention. The objects and advantages of the invention may be realized and attained by means of the instrumentalities and combinations particularly pointed out in the appended claims.

In order to achieve the foregoing and other objects, and in accordance with the purposes of the present invention as described herein, an improved apparatus is provided for pivotally moving an inverting arm of effective fixed pivotal length. The arm includes a feed carrier on one end to move between pickup and discharge locations about a constantly moving pivotal axis. More particularly, the apparatus includes a feed arm pivotally secured to a frame or a base for rotation about a first axis. An inverting arm has a follower with a pivotal axis at the end opposite the feed carrier. This follower is movingly disposed in a track. The feed arm is pivotally connected to the inverting arm to pivotally move the inverting arm about the follower's pivotal axis as the feed arm is rotated about the first axis. The follower is guidingly moved along the track simultaneously with the inverting arm's pivotal movement. This action occurs as the feed carrier is moved between pickup and discharge locations. The inverting arm's pivotal length thus remains constant due to the moving pivotal axis, and the carrier moves between the two locations without imposing any substantial change in speed in the middle of the cycle. The overall speed of the inverting arm is increased since the maximum design acceleration and speed built into the remaining portion of the drive linkage is maintained throughout the transfer operation.

Preferably, as mentioned above, the first axis is fixed relative to the base, and the feed arm is pivotally connected to the inverting arm intermediate the follower and the feed carrier.

In a specific aspect of the invention, a drive link is pivotally secured to the feed arm to rotate the feed arm about the first axis.

In a still further specific aspect of the invention, the track is secured to a guide member pivotally secured to the base about a second fixed axis.

In a still more specific aspect, the track preferably defines a movable straight line path wherein the movement path of the follower's pivotal axis in the track crosses the second fixed axis.

Still other objects of the present invention will become readily apparent to those skilled in this art from the following description wherein there is shown and described a preferred embodiment of this invention, simply by way of illustration of one of the best modes contemplated for carrying out the invention. As it will be realized, the invention is capable of other different embodiments, and its several details are capable of modifications in various, obvious aspects all without departing from the invention. Accordingly, the drawings and descriptions will be regarded as illustrative in nature and not as restrictive.

BRIEF DESCRIPTION OF THE DRAWINGS

The accompanying drawings incorporated in and forming a part of the specification, illustrate several aspects of the present invention, and together with the description serve to explain the principles of the invention. In the drawings.

Reference will now be made in detail to the present preferred embodiment of the invention, an example of which is illustrated in the accompanying drawings.

BEST MODE OF CARRYING OUT THE INVENTION

Figure 1:
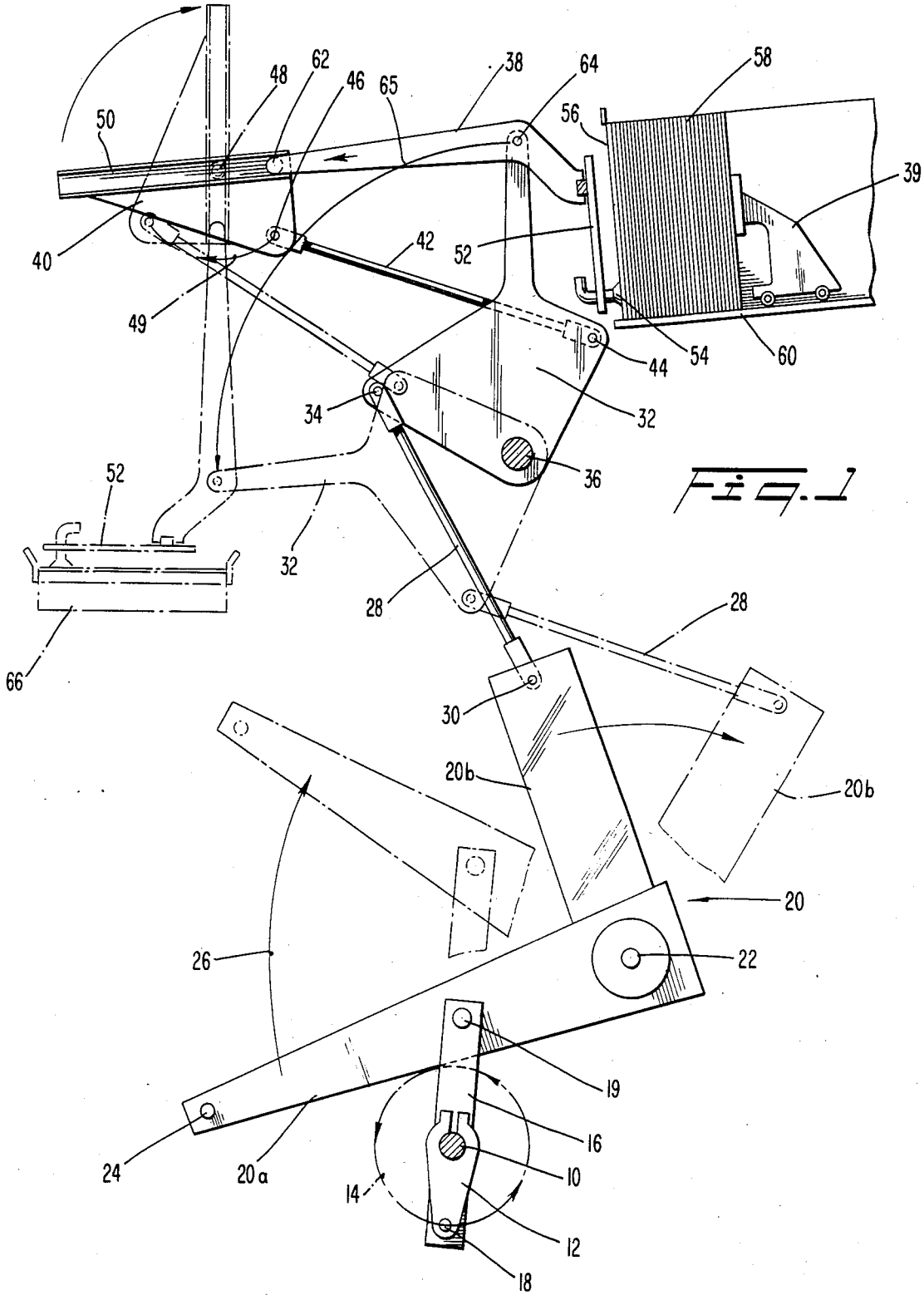
Fig. 1 is a side view of a carton transfer apparatus with an inverting arm and associated linkage in accordance with the present invention showing the relative positions during a feed movement.
Figure 4:
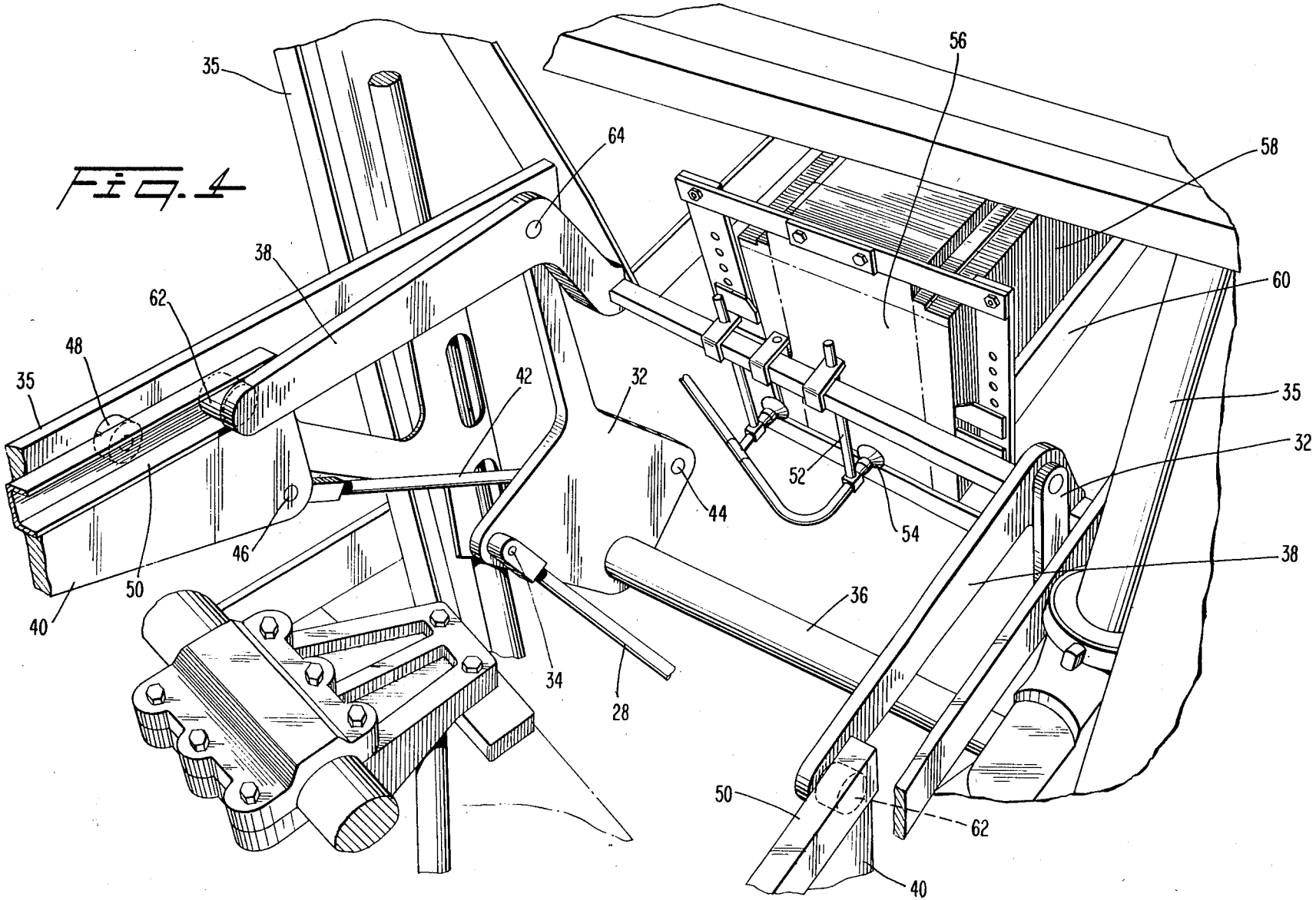
FIG. 4 is a perspective view of the transfer apparatus of a carton forming machine utilizing the inverting arm and associated linkage depicted in FIGS. 1–3.

Referring now to the drawings, an overall appreciation of the mechanics of the preferred embodiment is best realized from a joint viewing of FIGS. 1 and 4. Beginning first with FIG. 1 which depicts only one side of the preferred feeding mechanism, a main power shaft 10 is powered by non-illustrated but conventional means for continuous rotation to rotatably move one end of a rigidly attached crank 12 (only one of which is seen in FIG. 1). The crank 12 extends radially outward from the rotational axis of the power shaft 10 and is pivotally secured to an end of a drive lever 16 by a connecting pin 18. As represented by circle 14 in FIG. 1, the connecting pin 18 connecting the crank 12 and drive lever 16 is continuously moved in operation through a series of complete 360° circles by the continuous rotation of the main power drive shaft 10.

The opposite end of the drive lever 16, distal to the connecting pin 18, is pivotally connected to an intermediate portion of a first leg **20*a* of an L-shaped power arm 20 by a connecting pin 19. A second leg 20*b* of the power arm 20 is joined in substantially perpendicular relationship to one end of the leg 20*a*. A pivotal shaft 22 extends through both of the legs 20*a*, 20*b* at their adjoining ends to pivotally secure the power arm 20 to the machine frame or base (not in FIG. 1; see frame 35 in FIG. 4). The pivotal interconnection between the drive lever 16 and the leg 20*a* forces the power arm 20 in oscillating arcuate movement about the axis of the pivotal shaft 22 in accordance with rotation of the power drive shaft 10**.

The end of the leg **20*a* distal to the pivot pin 22 has a connecting pin 24 for pivotally securing that end of the leg 20*a* to a non-illustrated push rod. In a manner well known in the art, one end of the push rod is moved back and forth with the connecting pin 24 along an arcuate path represented by line 26, to effectuate upward and downward movement of a carton forming plunger (also not shown) attached to the end of the connecting rod at pin 24. This movement of the push rod and attached plunger is in timed relationship to angular rotation of the main power shaft drive 10**. However, inasmuch as this timed operation of the plunger is well known in the art and forms no part, per se, of the present invention, it has been omitted from the drawings for clarity of illustration.

The end of power arm leg **20*b* distal to the pivotal shaft 22 is pivotally secured to a drive link or rod 28 by a pin 30. The opposite end of the drive link 28, as also seen in FIG. 4, is in turn, pivotally secured by a connecting pin 34 to a drive arm 32. The drive arm 32 is pivotally secured to the machine frame 35 about a first fixed rotational shaft 36 in spaced parallel relationship to the connecting pin 34. As illustrated by the phantom line depictions of the link 28 and drive arm 32 in FIG. 1, rod 28 is operative to pivotally move the drive arm 32 about the first rotational shaft 36 fixed relative to the machine frame 35**.

Due to the relative positioning of the drive arm 32, the drive link 28 and the leg **20*b*, the drive arm 32 accelerates substantially constantly during the transfer cycle. This can be seen by viewing the substantial increase in the lever arms (defined by the pins 34 and 30, FIG. 1) as the apparatus operates. Of course, the crank 12** imposes the basic acceleration and decleration on the drive system. The objective of the present invention is not to impose additional acceleration factors into the system, and thus avoid amplified irregular movements that can cause the blanks being transfered to release or shift with respect to the carrier. The manner in which this is accomplished will become clear as this description develops below.

As seen in FIG. 4, there are actually two drive arms 32 which are pivotally connected to both a matching pair of inverting arms 38 and a pair of pivotal support members 40. The pivotal connection to the support member 40 is through a connecting link 42 and pins 44 and 46. The connecting pin 44 is in spaced relationship to both the connecting pin 34 and the rotational shaft 36. The rotational movement of drive arm 32 about shaft 36 effectuates arcuate movement of the connecting pin 44 and its associated end of connecting link 42. The support member 40 is also pivotally secured to the fixed machine frame or base 35 about a second rotational axis by a stub shaft 48. Thus, rotational movement of the drive arm 32 also produces rotational movement of the support member 40 about the shaft 48 in timed relationship to the rotation of the main power shaft 10. Line 49 in FIG. 1 represents the arcuate path of pin 46 as the member 40 is so rotated.

The support members 40 include a rectilinear double edge track 50 rigidly secured to the face. The longitudinal axis of track 50 passes over the axis of shaft 48 so as to rotate the track 50 about an axis perpendicular to its longitudinal axis. As will be apparent from the description below, the bodily rotating track 50 guides a pivoting end of the inverting arm 38 during movement between pickup and discharge positions.

The inverting arm 38 supports a feed carrier 52 at one end. The feed carrier 52 has a plurality of vacuum cups 54 for selectively engaging and removing a carton blank 56 from the forward end of a stack of blanks 58 disposed within a magazine 60. A weighted or spring biased pusher 39 incrementally advances the stack of blanks 58 toward the pickup position at the forward end of the magazine 60.

The pivoting end of the inverting arm 38 has a rolling follower 62 secured thereto. The follower 62 is disposed within the track 50 and movable along the track's longitudinal axis to permit the inverting arm to move back and forth in a controlled fashion. The connection between the drive arm 32 and the inverting arm 38 is intermediate the rolling follower 62 and the feed carrier 52 through a connecting pin 64.

It is thus seen that rotation of the drive arm 32 about the first fixed axis of rotational shaft 36 moves the feed carrier 52, with the forward blank 56 secured thereto, from the solid line to the phantom line positions of FIG. 1. As will be apparent from the drawings, this movement is basically a simple arcuate path for pin 64, as shown by the arrow 65, accompanied by pivoting of the arm 38. As a result of this composite movement of the inverting arm 38, the blanks are picked from the stack 58 seriatum, and deposited on forming die 66 in a smooth, controlled fashion, as will be discussed more in detail below.

The rolling follower 62 is movable within the guide track 50 along that track's longitudinal axis as the drive arm 32 is pivoted about shaft 36. Thus, the rotational axis of rolling follower 62 is moved relative to the member 40 during the movement of the feed carrier 52 and inverting arm 38 between the substantially horizontal pickup position, shown in the solid line outline, and the phantom line forming position.

The support member 40 and its attached track 50 are also rotated relative to the base 35 in timed relationship to the rotation of drive arm 32. This timed relationship is by virtue of the connecting link 42 between the drive arm 32 and the support member 40. As a consequence, the inverting arm 38, unlike the inverting arms of the prior art, moves the feed carrier 52 in the non-arcuate transfer path with a pivoted arm that is not varied in length through its swing. Maintaining the pivotal length of the inverting arm 38 at a constant length eliminates the variable speed and acceleration components associated with the center of the swing of the inverting arm in the prior art. Instead, the carrier 52 accelerates to the maximum speed as the blank 56 is picked off the stack, continues to move along the path and approaches the position where the blank is to be placed on the forming die 66. This provides substantially higher over all speed and production capacity for the transfer apparatus utilizing the inverting arm 38.

Figure 2:
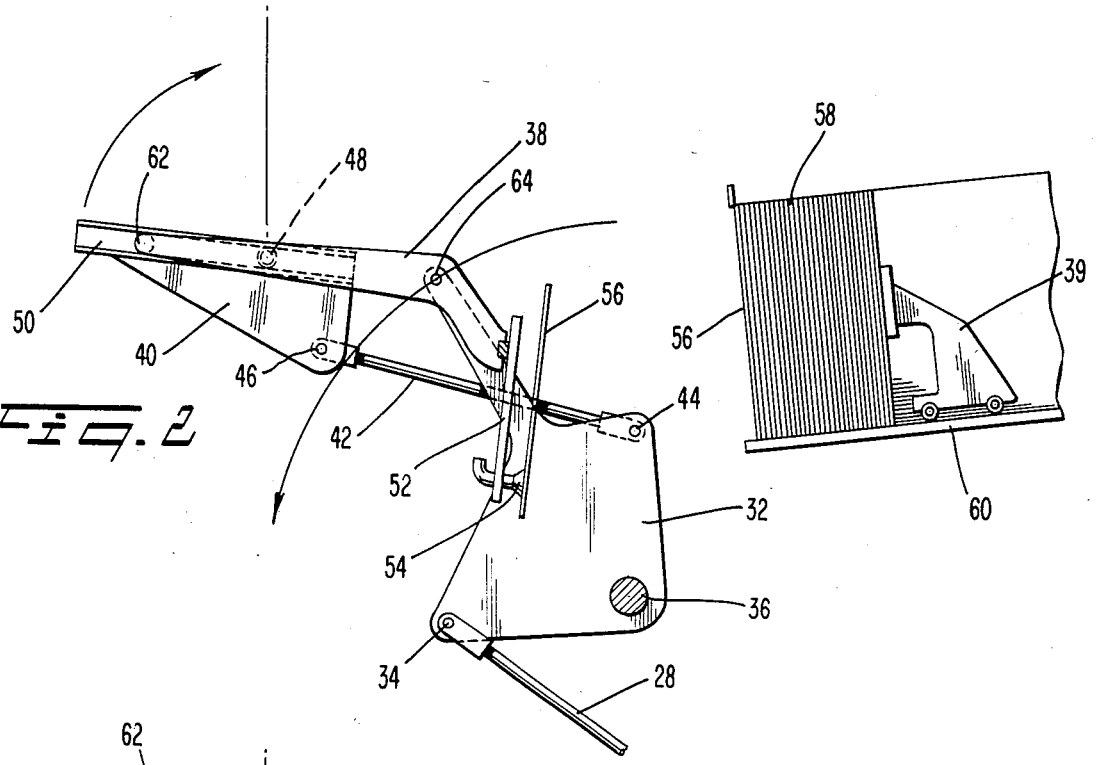
FIG. 2 is a side view similar to FIG. 1 showing the inverting arm and feed carrier at an intermediate position of its feed path transporting the forward most blank from a stack of blanks toward a forming station.
Figure 3:
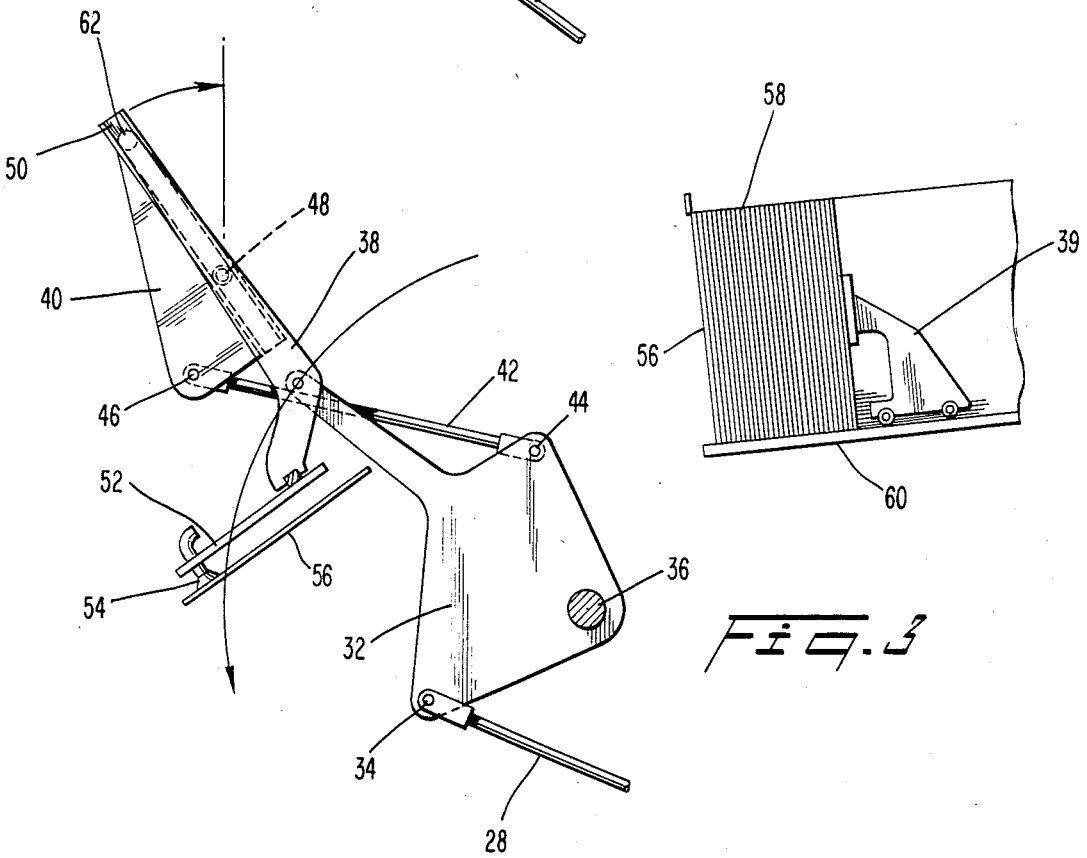
FIG. 3 is a side view similar to FIG. 2 but showing the inverting arm and feed carrier at a further intermediate position of its feed path moved toward the forming station.

The movement of the rotational axis of follower 62 back and forth along the longitudinal axis of track 50 during the movement of feed carrier 52 and the accompanying composite (non-accurate) path is most clearly illustrated in FIGS. 1–3. In FIG. 2, the feed carrier 52 is shown after having removed the blank 56 from the stack 58 and commenced its composite swing. It will be noted that in FIG. 1, the follower 62 is disposed near one end of the track 50. In contrast, FIG. 2 shows the same follower 62 disposed near the opposite end of the track 50 after the inverting arm 38 and feed carrier 52 are retracted from the magazine stack 58 and commence the pivoting movement toward the discharge position at the die 66, shown in phantom in FIG. 1. FIG. 3 depicts the position of the inverting arm 38 and feed carrier 52 in a further intermediate position along its movement path as the feed carrier 52 approaches the die 66 and actual discharge. In this further position, the follower 62 has moved even further along the track's longitudinal axis toward the opposite end of the track 50 and is ready to start the return. It will be further noted that the distance between the feed carrier 52 and the rotational axis, i.e., the inverting arm pivot length, remains constant throughout the feed movement. This alters the feed path of feed carrier 52 and results in a substantially accelerated, but smooth, feed movement while moving the feed carrier 52 between the pickup and discharge locations. There is no abrupt movement caused by acceleration of the inverting arm 38 in the middle of the cycle. Thus, the over all speed of the transfer operation can be increased. The effective length of the inverting arm is never reduced allowing smooth, constant acceleration to top speed and maintaining the blank 56 securely in position on the feed arm 52 until the blank 56 is deposited on the forming die 66.

In summary, numerous benefits have been described which result from employing the concepts of the invention. The inverting arm 38 of the transfer apparatus of the invention maintains a constant pivotal length throughout its feed path. This constant pivotal length is achieved by moving the inverting arm's pivotal axis at follower 62 during its feed movement. As a result, the intermediate acceleration associated with varying the inverting arm's pivotal length in the prior art has been eliminated. This constant pivotal length movement thus allows for higher production speeds as desired. The follower 62 establishing the pivotal length is guided along the bodily rotating track 50 creating the desired composite, but smooth movement of the carrier 52.

The foregoing description of a preferred embodiment of the invention has been presented for purposes of illustration and description. It is not intended to be exhaustive or to limit the invention to the precise form disclosed. Obvious modifications or variations are possible in light of the above teachings. The embodiment was chosen and described in order to best illustrate the principles of the invention and its practical application to thereby enable one of ordinary skill in the art to best utilize the invention in various embodiments and with various modifications as are suited to the particular use contemplated. It is intended that the scope of the invention be defined by the claims appended hereto.

I claim:

1. A carton transfer apparatus for transferring carton blanks between pickup and discharge locations by pivotally moving an inverting arm of fixed pivot length with a feed carrier on one end betwen the pickup and discharge locations and about a moving pivotal axis, comprising:

(a) a frame (b) a drive arm pivotally secured to said frame for rotation about a first axis;

(c) a track pivotally secured to said frame;

(d) an inverting arm having a follower defining a pivotal axis, said inverting arm having a feed carrier at one end, the follower being positioned on said inverting arm and guided by said pivotal track which forms substantially the entire path of travel for said follower so as to control movement of the inverting arm, said inverting arm being pivotally connected to said drive arm and pivotally movable about the follower's pivotal axis in response to rotation of said drive arm about the first axis; and (e) means for rotating said drive arm about said first axis and guidingly moving the follower freely along said track and simultaneously pivoting the inverting arm about the follower's pivotal axis as the feed carrier is moved between the pickup and discharge locations, wherby the inverting arm has an effective fixed pivot length and is pivoted about a moving pivotal axis to avoid imposing acceleration on said inverting arm and maintain control and smooth transfer movement of the carton blanks.

2. An apparatus as recited in claim 1 wherein said drive arm is pivotally connected to said inverting arm intermediate said follower and carrier.

3. An apparatus as recited in claim 2 wherein said follower is rotatably secured to said inverting arm on an end opposite the feed carrier.

4. An apparatus as recited in claim 3 wherein said track forms a channel and said follower is disposed in said channel.

5. An apparatus as recited in claim 3 wherein said first axis is fixed relative to said frame.

6. An apparatus as recited in claim 5 wherein said rotating means includes a drive link pivotally secured to said drive arm to rotate said drive arm about the first axis.

7. An apparatus as recited in claim 6 further including a support member pivotally secured to said frame, said track being secured to said support member.

8. An apparatus as recited in claim 7 wherein said support member is pivotally secured about a second axis fixed relative to said frame for orientating said track.

9. An apparatus as recited in claim 8 wherein said track is fixedly secured to said support member.

10. An apparatus as recited in claim 9 further including interconnecting means between said drive arm and said track support to rotate said support member in response to rotation of said drive arm.

11. An apparatus as recited in claim 10 wherein said track defines a movable straight line path.

12. An apparatus as recited in claim 11 wherein the movement path of the follower's pivotal axis in the track crosses the second fixed axis.

13. An apparatus as recited in claim 1, wherein said track is substantially rectilinear.

* * * * *